United States Patent [19]

Brian et al.

[11] Patent Number: 4,899,695

[45] Date of Patent: Feb. 13, 1990

[54] FLUIDIZED BED COMBUSTION HEAT TRANSFER ENHANCEMENT

[75] Inventors: Pierre L. T. Brian; Sheldon W. Dean, Jr., both of Allentown, Pa.

[73] Assignee: Air Products and Chemicals, Inc., Allentown, Pa.

[21] Appl. No.: 310,560

[22] Filed: Feb. 14, 1989

[51] Int. Cl.[4] ..... F22B 1/00; F23D 1/00

[52] U.S. Cl. ..... 122/4 D; 431/7; 431/170; 432/14; 432/58; 110/347; 110/346

[58] Field of Search ..... 431/7, 170; 122/4 D; 432/14, 15, 58; 110/245, 263, 346, 347, 343; 422/7, 9, 10, 11

[56] References Cited

U.S. PATENT DOCUMENTS

| | | | |
|---|---|---|---|
| 3,645,237 | 2/1972 | Seth | 122/4 D |
| 3,888,193 | 6/1975 | Kishigami et al. | 110/346 X |
| 4,157,245 | 6/1979 | Mitchell et al. | 48/197 |
| 4,311,670 | 1/1982 | Nieminen et al. | 422/145 |
| 4,338,283 | 7/1982 | Sakamoto et al. | 431/7 X |
| 4,435,148 | 3/1984 | Moss | 431/7 |
| 4,619,314 | 10/1986 | Shimoda | 122/4 D X |
| 4,704,084 | 11/1987 | Lill et al. | 431/7 |
| 4,771,712 | 9/1988 | Engstrom et al. | 110/347 |

*Primary Examiner*—Randall L. Green

*Attorney, Agent, or Firm*—Keith D. Gourley; James C. Simmons; William F. Marsh

[57] ABSTRACT

A process for enhancing heat transfer between combustion products formed in a fluidized bed combustion (FBC) reactor and the water-containing tubes surrounding the reactor wherein particles of an inert material, e.g., mineral calcium sulfate (gypsum), having a spheroidal shape ranging in size from about 50 to 1000 μm and having a Moh's hardness of between 2.0 and 4.0 are introduced into the reactor in the presence of a solid fuel and an oxygen-containing gas. Introduction of such particles into the FBC reactor increases the particle density within the reactor thereby increasing radiant and convective heat transfer between the circulating bed and the surrounding water cooled walls. The improved process allows more precise control of the operating temperature regime. Erosion of the reactor walls is also substantially reduced.

5 Claims, 1 Drawing Sheet

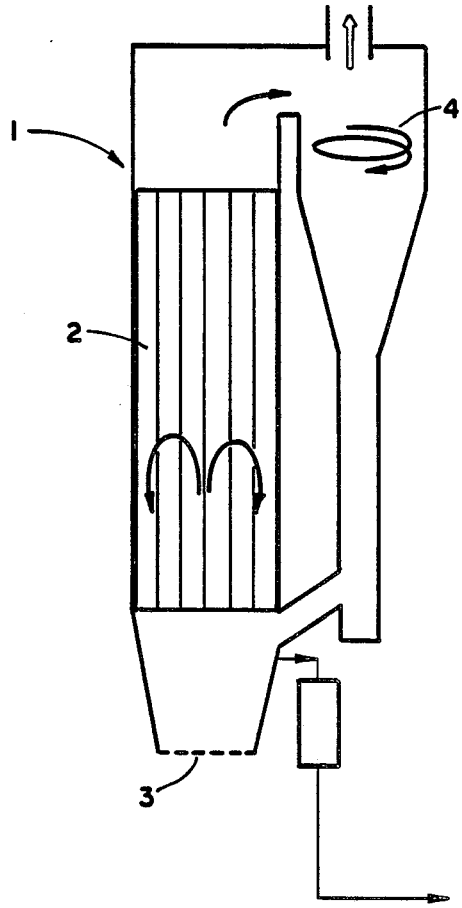
1
2
3
4

FLUIDIZED BED COMBUSTION HEAT TRANSFER ENHANCEMENT

TECHNICAL FIELD OF THE INVENTION

The present invention relates to a process for enhancing heat transfer and reducing erosion of operating components in a fluidized bed combustion reactor.

BACKGROUND OF THE INVENTION

Circulating fluidized bed combustion (FBC) reactors are being utilized in an increasing number of applications including the generation of steam wherein fossil fuels such as coal are used as a fuel source. FBC reactors typically utilize fuels having a lower energy content than are used in standard boiler furnaces. FBC reactors are favored over conventional boiler systems because the combustion flue gas can be desulfurized economically before being emitted into the atmosphere.

In a typical process for producing and recovering heat energy which employs a circulating FBC reactor, a solid fuel and an oxygen-containing gas are introduced into a reactor or furnace and combusted to form hot exhaust gases containing ash particles. The ash-containing exhaust gas is discharged from the furnace and cooled by indirect heat exchange against the water-containing tubes surrounding the reactor to form a cooled exhaust flue gas thereby providing energy for generating steam or heating water. Heat exchange is typically effected by lining the walls of the reactor with tubes or lines carrying water. Such tubes or lines are capable of capturing a significant portion of the heat generated during combustion by such indirect heat exchange. A portion of the solid particles entrained in the exhaust gas is separated and collected for disposal while an additional portion is recycled into the combustion unit.

Heat transfer between the hot flue gas containing ash particles and the cooling tubes occurs by a combination of radiant and convective cooling. Radiation is an especially important form of heat transfer in high temperature systems. Normally, in combustion processes, the gaseous products radiate heat to the heat transfer surfaces. Radiant heat transfer becomes less efficient as the combustion gases cool and convection becomes the dominant heat transfer mechanism.

In the case of FBC reactors, radiant heat transfer from solid particles to the heat transfer surfaces is the predominant mechanism although convection plays an important role. Radiant heat transfer from the gaseous combustion products plays only a minor role in the process. Proper heat transfer is dependent upon maintaining an adequate concentration of ash particles within the reactor which promotes mixing and heat transfer. If the average ash particle size is too small, ash tends to fly out of the reactor causing a rise in temperature which negatively impacts on the efficiency of pollutant removal.

The combustion of certain coals produces ash having very fine particles known as fly ash which tend to be blown out of the reactor bed and the accompanying cyclones. The loss of such fly ash causes the particle density in the reactor to drift below the operating range which is most effective for promoting heat transfer rendering a reactor temperature which is too high to conduct efficient removal of pollutants. Consequently, the $SO_x$ and $NO_x$ content of the flue gas may exceed permissible levels established by federal and state governments which could result in assessment of penalties and/or imposition of an injunction against the continued operation of the plant.

Several approaches have been proposed for enhancing heat transfer between the heated flue gas containing ash particles and the water-containing tubes surrounding the reactor. For example, bottom ash classification and recycling are practiced to maintain the particle density in the combustion zone within the desired size range. Excess limestone beyond the amount necessary to effect desulfurization may be added into the combustion reactor to enhance heat transfer. However, this solution is not entirely satisfactory because calcined limestone catalyzes $NO_x$ formation from nitrogen containing fuel sources thereby creating an additional pollutant.

Sand addition has been used as an inert bed in the startup of FBC reactors and can be used to maintain combustion bed density. While sand is adequately inert and does not suffer unacceptable attrition during the combustion process, sand is extremely erosive and can cause unacceptable wear of the pipes, heat transfer surfaces and refractory surfaces within the reactor. Consequently, the increased down time of plants required for repair of eroded surfaces has made the use of sand addition very undesirable.

U.S. Pat. No. 3,645,237 discloses a FBC system for use in commercial boiler systems. An order-of-magnitude increase in heat transfer rate is achieved by utilizing a bed of inert material (such as sand) at velocities which cause the bed to become fluidized. Suitable materials are granular particles ranging in size from 0.001 in. (25 μm) to about 0.10 in. (2500 μm) in diameter. Particles of roughly 46 mesh (0.0013 in., 32 μm)) are generally preferred. The particles are refractory materials which withstand very high temperatures without fracturing or crumbling during the process. Suitable particles include various metal alloys, ceramic material and other inert materials such as alumina, zirconia or mullite.

U.S. Pat. No. 4,157,245 discloses a process for gasifying a solid carbonaceous material in a gasification zone wherein such zone includes means for substantially impeding vertical back mixing of vertically moving solids which comprises introducing a heat transfer material into an upper portion of the gasification zone. A preferred heat transfer material is sand.

U.S. Pat. No. 4,704,084 discloses a method of lowering nitrogen oxides to a desired level and minimizing sulfur dioxide in the reaction gases formed during combustion of fuel in a FBC reactor. The FBC reactor has a lower dense fluidized bed of relatively large particles, an upper dispersed entrained bed of relatively fine particles recirculating through the dense fluidized bed and an entrained sulfur sorbent material therein. The method comprises the steps of:

(a) operating a lower region of the multisolid fluidized bed under substoichiometric conditions such that $NO_x$ is reduced to the desired level;

(b) operating an upper region of the multisolid fluidized bed above the substoichiometric lower region under oxidizing conditions to complete the combustion of the fuel;

(c) maintaining a size difference between the relatively large particles and the relatively small particles such that substantially all of the large particles are at least four times the size of substantially all of the small particles; and (d) recycling a portion of the relatively fine particles through the lower region of the dense bed operation under substoichiometric conditions and a portion of the relatively fine particles from the entrained bed through substantially only the upper region which is operating under oxidizing conditions thereby depressing the temperature of such oxidizing region to a level conducive to sulfur capture by the sulfur sorbent material and operating the lower region at as low a temperature as will support combustion.

U.S. Pat. No. 4,771,712 discloses a method of burning solid fuel containing low melting point alkaline compositions such as alkali metal salts. A fuel such as lignite or salty brown coal is introduced into the reaction chamber of a circulating fluidized bed reactor and is mixed prior to introduction to the reaction chamber with a reactant material capable of reacting with the low melting point alkaline compositions of the fuel to produce a high melting point alkali metal compound during combustion. The temperature in the reaction chamber is kept below the melting point of the formed alkali metal compounds. The reactant material comprises silicon dioxide, an oxide, metal oxide or hydroxide of aluminum, calcium, magnesium, iron, titanium or a mixture of two or more thereof. Kaolin is particularly effective when the molar ratio of Al/Na and K is at least 1.0.

BRIEF SUMMARY OF THE INVENTION

The present invention relates to an improved process for enhancing heat transfer within a FBC reactor and the water-containing tubes surrounding the same and reducing erosion caused by the abrasive action of the process fuel. The process can be practiced in conventional fluidized bed combustion units.

More particularly, an improved process is disclosed for burning solid fuel in a circulating fluidized bed reactor to produce and recover heat energy wherein a material having inert particles of spheroidal shape having a Moh's hardness of between 2 and 4 and a particle size of 50 to 1000 μm is introduced into the FBC reactor. Addition of the particulate material into the reactor improves heat exchange between the fluidized bed and the walls of the bed reactor and reduces erosion of the walls, heat transfer surfaces and refractory surfaces.

The preferred material is gypsum having a particle size ranging from 100–400 μm. Optimum particle size will depend the specific application. For example, a FBC reactor having a flue gas velocity within the range of 10–20 ft/sec. operates most efficiently with introduction of gypsum particles wherein 90% of the particles are greater than 100 μm and less than 10% are greater than 400 μm.

The injection of such particles into the FBC reactor increases the particle density within the reactor bed thereby increasing radiant and convective heat transfer from the circulating bed to the water-containing tubes surrounding the reactor and allows finer control over the operating temperature regime.

BRIEF DESCRIPTION OF THE DRAWING

The single FIGURE is a schematic diagram of a fluidized bed combustion unit suitable for practicing the process of the claimed invention.

DETAILED DESCRIPTION OF THE INVENTION

Heat transfer design and regulation is essential for maintaining an efficient fluidized bed combustion (FBC) process which complies with the increasingly strict federal and state environmental clean air standards. For example, the removal $SO_x$ from combustion flue gas by reaction of sulfur dioxide with calcined limestone is strongly dependent on temperature. Unduly low reactor temperatures result in substantially decreased sulfur capture. If the reaction temperature is too high, pores in the calcium oxide can sinter and plug before the surface can adsorb $SO_x$. Pollutant retention can also be limited by equilibrium in oxygen-deficient regions. The observed optimum temperature range for sulfur capture is 1500° to 1650° F., with steep declines possible outside this range.

The present invention is a process for enhancing heat transfer in conventional FBC processes known in the art. The invention has broad applicability in FBC reactors of diverse design and size wherein operating conditions such as temperature, energy content of the fuel and the like vary substantially. Representative of FBC reactors suitable for practicing this process in U.S. Pat. No. 4,311,670, the Specification which is incorporated by reference.

The process of this invention enhances heat transfer between a FBC reactor and the water-containing tubes surrounding the reactor and allows finer control of the operating temperature regime. Additionally, erosion caused by heat transfer materials used in the art (i.e., sand) is substantially reduced. The improvement to conventional FBC processes resides in introducing particles into the combustion unit having a spheroidal shape ranging in size from about 50 to 1000 μm, preferably between 100 μm and 400 μm, and having a Moh's hardness of between 2.0 and 4.0, preferably 2.1 to 2.5. Particles of the desired size may be ground by those methods known in the art and separated by conventional screening techniques.

The degree to which particles in the reactor are optimized for maximum heat transfer at minimum pressure drop is known as "bed quality". Bed quality depends on many factors, few of which are controllable during plant operation. The process of this invention allows for convenient and efficient regulation of reactor bed quality by controlling the type and concentration of particles within the reactor. Additional or "makeup" gypsum can be added to the reactor to maintain optimum heat transfer.

In typical circulating FBC reactors, the size and quantity of ash particles within the furnace must be regulated to achieve the desired heat transfer between the fuel being combusted and the walls of the furnace which have imbedded tubes or lines capable of adsorbing reactor heat of combustion by indirect heat exchange. The task of maintaining the desired ash particle size and distribution within the furnace is made easier by the addition or removal of the disclosed inert particles which will be described herein in greater detail.

The injection of particles of the enumerated materials into the FBC reactor increases particle density within the bed thereby increasing radiant and convective heat transfer from the circulating bed to the water cooled walls. The unit can then be operated in a temperature regime in which hot limestone desulfurization is effective and erosion of the combustion unit walls is reduced.

The preferred heat transfer material is mineral gypsum. Gypsum is softer than sand and is not as erosive. Moreover, mineral gypsum does not catalyze NO formation from nitrogen contained in the coal, as does limestone. Gypsum is also inexpensive and readily available as opposed to some additives known in the art. Natural gypsum is preferred because gypsum waste from acid neutralization is generally composed of fine agglomerated crystals and does not have sufficient mechanical strength to survive within the combustion environment.

Although the particle size of the heat transfer material should be maintained within the above-described range, a more uniform size may be desired depending upon the specific application. For example, in a FBC unit operating with a flue gas velocity within the range of 10–20 ft/sec, gypsum particle diameter should range from 100–400 μm, i.e., 90% of the particle mass greater than 100 μm and less that 10% greater than 400 μm.

During operation, gypsum particles become dehydrated and are converted to the anhydrite form. However, this dehydration process does not affect the strength of the particles. The material selected for enhancing heat transfer must not suffer degradation from thermal exposure to temperatures approaching 1800° F. (1000° C.). p The chemical and physical characteristics of gypsum are presented in Table 1. Gypsum is more accurately described as calcium sulfate dihydrate ($CaSO_4 \bullet 2H_2O$). Upon heating, gypsum loses water to form calcium sulfate hemihydrate ($CaSO_4 \bullet \frac{1}{2}H_2O$) and anhydrous $CaSO_4$. Calcination, the process of removing water from the mineral, in this case gypsum, begins at temperatures above 70° C. The gypsum described herein loses crystal water in two distinct steps, at 90°–140° C. and 140°–170° C., respectively. In the temperature range of 90° C. to 220° C., calcium sulfate dihydrate and hemihydrate lose crystal water to form soluble anhydrite III. The polymorphic transformation of soluble anhydrite III to insoluble anhydrite II occurs in the temperature range of 300°–400° C. The insoluble anhydrite II is commonly referred to as "Deadburnt" gypsum.

TABLE 1

| Composition | Crystal Structure | Aggregation State | Surface Properties SA ($cm^2/g$) | Porosity |
|---|---|---|---|---|
| $CaSO_4.2H_2O$ | Monoclinic | Natural rock ground | 7–10,000 | Low |
| | | β-hemihydrate | 24,000 | Low |
| $CaSO_4.\frac{1}{2}H_2O$ | Hexagonal | α-hemihydrate | 5,000 | Low |
| | | β-hemihydrate | 75,000–80,000 | High |
| | | Aged β-hemihydrate | 25,000 | Low |
| $CaSO_4$ III | Hexagonal | Dehydrated α | 150,000 | High |
| $CaSO_4$ II | Orthorhombic | Natural | 5–6,000 | Low |
| | | "deadburnt" | | High |

At temperatures between 500° and 730° C., decomposition of calcium and magnesium carbonates existing as impurities in the mineral take place. In some samples, a small weight loss due to decomposition of $MgSO_4$ in the natural mineral occurs between 950° and 1200° C. The decomposition temperature of calcium sulfate is most often reported as 1200° C. However, literature reports decomposition temperatures as low as 900° C., 1000° C. or 1030° C. depending on the amount and nature of impurities and the combustion conditions employed in the particular process.

The instant process which utilizes the disclosed particles for enhancing heat transfer and reducing component erosion is suited for use in conventional FBC processes and does not require equipment retrofitting or modification of existing operating conditions. Such processes typically comprise introducing a solid fuel such as coal and an oxygen-containing gas into the FBC reactor, burning the fuel in the presence of the oxygen-containing gas to form a hot exhaust gas containing solid combustion particles, discharging the hot exhaust gases from the reaction chamber, cooling the exhaust gases by indirect heat exchange against the walls of the reactor bed, separating at least a portion of the solid particles from the cooled exhaust gases and recycling a portion of the separated solid particles into the reaction chamber. The heat energy generated during the process may be utilized to generate electricity and/or low pressure stream for alternate uses.

A typical FBC unit is disclosed in the single FIGURE. The combustion box 1 is constructed entirely of steam-generating tubes which are joined by short webs which form a pressure seal. The studded tubes near the bottom of the box may optionally be covered with refractory material before beginning operation of the process. Vertical water-containing tubes 2 within combustion chamber 1 are the primary heat transfer surfaces. Crushed coal and gypsum are feed by conventional means into the bottom of combustion chamber 1. The solids mixture is fluidized and preheated primary air is introduced through distributor grid 3 while secondary air is added at various levels above the grid (not shown). Optionally, limestone and calcium sulfate can be added to the solids mixture and introduced into the combustion chamber for control of emissions, typically $NO_x$ and $SO_x$. Process steps for practicing control of such emissions are well known in the art and are not critical to the practice of this invention. While circulating FBC units have lower $NO_x$ emissions than other coal-burning technologies, auxiliary steps must often be taken to ensure that process emissions comply with state and federal pollution guidelines.

Upon combustion, coal ash, excess limestone and calcium sulfate flow out of the top of combustion chamber 1 into a conventional cyclone 4. A portion of the solids are captured in cyclone 4 and returned to combustion reactor 1 while finer solids can be captured by use of fabric filters. The combustion process produces a large amount of ash per unit quantity of fuel source. Consequently, very large amounts of particulate ash solids come into contact with the walls of the reactor which contribute to erosion of reactor heat transfer surfaces and refractory surfaces. The use of gypsum as a heat transfer medium substantially reduces this erosion problem.

The degree to which the distribution and quantity of particles within the combustion bed is optimized to achieve maximum heat transfer at minimum pressure drop is known as "bed quality". The process of this invention allows for convenient and efficient regulation of the bed quality by controlling the amount of gypsum within the combustion unit. Additional or "makeup" gypsum can be added to the combustion unit if the desired heat transfer begins to decay.

The following example illustrates an operative embodiment of the process and is not intended to be limit the scope of the claimed invention.

EXAMPLE 1

A FBC reactor (90 ft. in height) is operated to produce steam. The unit is designed to receive coal having a heating value of 11,300 BTU/lb. and containing 9.0% ash, 0.4% sulfur and 10% moisture. This coal, when burned under normal conditions, produces fine ash particles having a diameter of about 10 μm. In order to achieve proper operation of the FBC reactor approximately 75 lbs/ft$^2$ of bed cross section of sand particles are introduced into the unit and the furnace is brought to an operating temperature of about 1600° F. by combusting natural gas. Coal is added gradually until a normal operating condition is achieved whereby 71.3 lbs/hour/ft$^2$ of bed cross section of coal is added at steady state. This rate permits 625 lbs/hour/ft$^2$ of bed cross section of steam to be vaporized. Limestone may be added into the reactor to facilitate desulfurization of the coal. Typically, limestone is added at a rate of 2.5 lbs/ft$^2$ of bed cross section to achieve about 33% conversion of limestone to calcium sulfate. Sand is added as necessary, typically at a rate of 0.2 lbs/hour/ft$^2$ of bed cross section to maintain the particle density suitable for achieving the desired heat transfer rate. Under these operating conditions, erosion of up to 250 μm per day of the steam generating tube surfaces can occur.

EXAMPLE 2

The FBC unit described in Example 1 is utilized wherein startup is conducted using mineral gypsum ($CaSO_2 2H_2O$) ground to a size range wherein 90% of the particles are greater than 100 μm and 10% of the particles are greater than 400 μm (nominal size—150 μm). The gypsum is added at 85 lbs/ft$^2$ of bed cross section during start up of the reactor. Similar operating conditions are followed resulting in equivalent steam generation and pollution abatement. The expected erosion rate is less than 2.5 μm/day resulting mainly from abrasion caused by ash particles. A gypsum addition rate of 4 lbs/hr/ft$^2$ of bed cross section is necessary to maintain the desired particle density within the reactor.

Introduction of an inert material having particles of the enumerated size and hardness into conventional FBC reactors allows for optimum control of the particle density within the reactor thereby increasing radiant and convective heat transfer between the circulating bed and the surrounding water-containing heat exchange tubes. This process allows finer control of the operating temperature regime and substantially reduces erosion of heat transfer surfaces and refractory surfaces within the reactor.

Having thus described the present invention, what is now deemed appropriate for Letters Patent of the United States is set out in the following appended claims.

What is claimed is:

1. A process for operating a fluidized bed combustion reactor which is surrounded by water-cooled tubes comprising the steps of:

(a) introducing a solid fuel and an oxygen-containing gas into the reactor;

(b) burning the fuel in the presence of the oxygen-containing gas and a material having inert particles of spheroidal shape possessing a Moh's hardness of between 2 and 4 and a particle diameter of about 50 to 1000 μm to form a hot exhaust gas containing solid particles;

(c) discharging the hot exhaust gas containing the solid particles from the reactor and cooling the exhaust gas by indirect heat exchange against the water cooled tubes of the reactor; and (d) separating and recycling a portion of the separated solid particles into the fluidized bed reactor whereby erosion of the water-cooled tubes is substantially reduced.

2. The process according to claim 1 wherein the inert particles of spheroidal shape have a particle size of between 100 and 400 μm.

3. The process according to claim 1 wherein at least 90% of the inert particles are larger than 100 μm and less that 10% are greater than 400 μm.

4. The process according to claim 1 wherein the inert particle having spheroidal shape is mineral gypsum.

5. The process according to claim 1 wherein erosion of the water-containing tubes surrounding the reaction chamber is less than 2.5 μm/day.

* * * * *